US005979676A

United States Patent [19]

Wüster

[11] Patent Number: 5,979,676

[45] Date of Patent: Nov. 9, 1999

[54] CLOTHING DRYER OR UMBRELLA FRAME

[76] Inventor: Heinrich Wüster, Unterm Hohen Rain 16, A-6460 Imst, Austria

[21] Appl. No.: 09/136,602

[22] Filed: Aug. 19, 1998

[30] Foreign Application Priority Data

Aug. 20, 1997 [AT] Austria ..... 1397/97

[51] Int. Cl.[6] ..... D06F 53/02

[52] U.S. Cl. ..... 211/119.01; 211/197; 135/22; 135/25.32; 135/33.2

[58] Field of Search ..... 135/15.1, 22, 25.31, 135/25.3, 25.32, 26, 33.2, 25.34; 211/119.01, 167, 197

[56] References Cited

U.S. PATENT DOCUMENTS

| | | | |
|---|---|---|---|
| 2,289,450 | 7/1942 | Pollard et al. . | |
| 2,415,908 | 2/1947 | Pollard . | |
| 2,616,570 | 11/1952 | Griffin . | |
| 2,794,556 | 6/1957 | Lego . | |
| 4,550,840 | 11/1985 | Van Deursen | 211/197 |
| 4,610,364 | 9/1986 | Meade | 211/183 |
| 4,735,322 | 4/1988 | Steiner | 211/119.01 |
| 4,830,202 | 5/1989 | Steiner | 211/197 |
| 5,280,841 | 1/1994 | Van Deursen | 211/197 |
| 5,492,232 | 2/1996 | Ohm | 211/197 |

*Primary Examiner*—Christopher T. Kent
*Assistant Examiner*—Yvonne Horton-Richardson
*Attorney, Agent, or Firm*—Herbert Dubno

[57] ABSTRACT

A laundry dryer umbrella or like frame has between bracing arms and main arms, respective swing arms which form with each bracing and main arm a three link chain which can buckle inwardly at the swing arm so that the main arm assumes a slightly open positioning, thereby facilitating movement of the star-shaped parts to which the bracing arm and main arm are connected, toward one another for opening of the frame.

6 Claims, 2 Drawing Sheets

CLOTHING DRYER OR UMBRELLA FRAME

FIELD OF THE INVENTION

The present invention relates to a frame, preferably for a clothing dryer or umbrella, especially a garden umbrella, of the type in which a star-shaped array of outward swingable arms are pivotally connected to a member on a support tube and each of these arms is connected, in turn, to a respective bracing arm connected to another star-shaped member on the support tube, whereby, as the main arms swing outwardly, the bracing arms swing away from the support tube into the open position of the frame upon movement of the star-shaped member relatively toward one another.

BACKGROUND OF THE INVENTION

A clothing dryer frame can be provided with a star-shaped array of main arms which are swingable outwardly from a closed position of the frame and wherein the main arms are spanned by cords or the like to support laundry to be dried. Umbrella frames, especially for garden umbrellas can have main arms spanned by a canopy. Such frames are characterized by an arrangement in which the star-shaped two members on the support post can be moved toward and away from one another for the opening or closing of the frame respectively.

More particularly, such a frame can comprise a tubular support post which can have a first star-shaped member axially fixable thereon and forming pivots for the main or support arms. A second star-shaped member which also can be axially fixed to the support tube can be formed with pivots for the bracing arms and, by axial shifting of one of the star-shaped members, the main and bracing arms can be swung between the closed positioning which the arms lie along the support tube, and an open position in which the arms are spread outwardly.

Between each main arm and a respective support arm, a knuckle joint is provided which is opened up upon the spreading of the arms and which is folded inwardly when the arms are closed.

In the opening of the frame, assuming that the main and bracing arms have been swung inwardly to lie generally along the post, opening or spreading of the frame is effected by moving one of the star shaped members axially along the support tube toward the other of these members until the cords or canopy are tensioned and the main arms are spread outwardly and are fixed under tension. The movable star-shaped member can then be secured on the support tube. To fold the main arms again inwardly, the axial fixation of the movable star-shaped member is released and that member is then moved away from the fixed star-shaped member until the canopy and cords are drawn inwardly and the main arms are caused to lie along the support tube. In this inwardly swung position of the arms, the movable star-shaped member can be clamped axially once again to hold the frame in its folded position. The force required to open the frame, especially when the bracing and main arms are aligned in the direction of force application, can be substantial.

The support tube or post may be vertically anchored in a base or stand in the case of a garden umbrella, or in the ground in the case of a laundry dryer. The fixed star-shaped member is usually provided at the top of the post and the movable star shaped member is spaced below the latter and can pivotally carry the bracing arms for swinging outwardly the main arms which are pivotally mounted on the upper or fixed star-shaped member.

A detent system can be provided for locking the lower star-shaped member along the support tube.

For clothing dryers or the like which are mounted in the ground, the star-shaped member to which the bracing arms are pivoted may be located above the star-shaped member to which the main arms are pivotally connected and to swing the main arms outwardly, the upper star-shaped member may be drawn downwardly toward the lower star-shaped member and locked in place appropriately along the post.

In most cases, the frame is closed until it is to be used and only then opened, whether it is permanently mounted in a vertical position or can be laid down. When, however, the dryer or umbrella is to be used to hang up laundry or protect an area from rain or sun, the frame must be swung into its open position. In practice, the opening of the frame has required considerable force even for an initial spreading of the main arms and the bracing arms outwardly. Until this initial resistance has been overcome, it is not possible to relatively move the star-shaped members easily so as to continue the outwardly spreading operation. After this initial resistance, the movement of the movable star-shaped member must overcome the weight of the arms and any canopy or cords thereon.

For laundry dryers, usually four main arms are provided and once these arms are fully swung outwardly, they must be able to carry the weight not only of the arms and the cords, but also the considerable weight of wet, heavy laundry in a stable manner. The force necessary for opening the frame in the past has, therefore, been relatively high. Furthermore, the lower star-shaped member is frequently located so close to the ground that it is difficult for the user to exercise even the initial force required to spread the main arms outwardly without awkward manipulation or bending.

Various proposals have been made to ease the outward spreading of the arms of such frames. For example, it has been proposed to connect the two star-shaped members by a cable which can run from one to the other along the support tube and can be diverted at the lower star shaped member away from the post. To swing the arms of the frame outwardly, the cable is drawn upwardly at an angle to the post and radially outwardly from the star-shaped member close to the ground. The cable eliminates the need for the operator to bend, but the significant resistance of the frame to opening is not easily overcome through the use of the cable which itself introduces a significant frictional component.

EP 113 789 B1 discloses an umbrella like laundry dryer with a star-shaped member fixed axially at the upper end of the support tube and a cable passing twice between the upper and lower star-shaped members in an effort to gain a mechanical advantage. The bracing arms are pivotally mounted on the upper star-shaped member and are radially inwardly offset with respect to the outer periphery of the support tube. The support arms themselves are of an offset nature. In this kind of system, there is indeed a facilitation of the opening operation, but the system is more expensive to fabricate and has tended to be more bulky.

U.S. Pat. No. 2,289,450 discloses another kind of umbrella shaped dryer in which, in the closed position of the frame, the knuckle joints between the support arms and the bracing arms lie outwardly of the lines connecting the pivots for the support arms at the lower star-shaped member and the bracing arms at the upper star-shaped member. The star-shaped members are comprised of two elongated sleeves which have ends turned toward one another and locked together when the arms are in their fully spread positions.

The support arms are formed with projections at their ends connected to the upper star-shaped member which project radially inwardly of the periphery of the support tube in the fully spread positions of the arms. The locking system is here comparatively complex as well.

EP 220 565 A2 describes an umbrella shaped laundry dryer which has at the upper end of the post or support tube an axially fixed second star-shaped member to which a cable is affixed while the lower star-shaped member, about which the cable passes, forms the pivots for the support arms. In this arrangement, there is a danger that the lover star-shaped member, which is free to wobble, may be jammed in use. There is also a problem here with an increasing tendency to jam with greater application of force to the cable. Finally, mention may be made of the umbrella type laundry dryer of EP 649 935 which requires that the bracing elements penetrate through openings in the support tube or post radially and which has been found to be a drawback because openings in the support posts tend to weaken the latter.

OBJECTS OF THE INVENTION

It is, the principal object of the present invention to provide an improved frame, especially for an umbrella or laundry dryer of the kind described, whereby these various disadvantages are obviated.

Another object of this invention is to provide a frame for the purposes described which will facilitate the spreading of the main arms and bracing arms, and especially reduce the force which may be necessary for opening of the frame.

SUMMARY OF THE INVENTION

These objects and others which will become apparent hereinafter are attained, in accordance with the invention by providing between the bracing arms and the main arms of a frame for a dryer, umbrella or the like, of a short link or pivot arm (swingable arm) which will reduce the force necessary to move the star-shaped members toward one another from the initial closed position of the arms and thereby facilitate spreading so that problems hitherto encountered when the bracing arms are directly linked to the main arms and the arms are swung inwardly against the support tube or post, can be obviated.

More particularly, the objects of the invention are attained with a support frame which comprises a support tube or post, a first star-shaped member which can be axially fixed to and surrounds the support tube, a plurality of support or main arms swingably connected to this first star-shaped member, a second star-shaped member shaped member axially fixable to the support tube and surrounding same, a plurality of bracing arms pivotally connected to the second star-shaped member and swingable with the main arms between inwardly swung positions close to the support tube in a closed orientation of the frame and outwardly swung positions in an open orientation of the frame, and a respective pivot arm pivotally connected between each main arm and the respective bracing arm, so that each swing arm forms the intermediate member of a three member chain of links constituted by the main arm, bracing arm and swing arm or pivot arm interconnecting the two star-shaped parts. When the arms are swung inwardly and outwardly, the presence of the intermediate link prevents direct alignment of the bracing arm and the main arm in the force transmitting direction so that opening is facilitated. In other words, the chain of links can buckle inwardly in the region of the pivot or swung arm and thus allow the main arm and bracing arm to easily swing outwardly as the two star-shaped parts are moved relatively toward one another.

With the frame according to the invention, the main and bracing arms each form the end links of a three link chain in which the shorter intermediate or swing arm is the connecting member. The swing arm prevents a stiffening of the chain when the arms are swung inwardly into the closed position of the frame by preventing direct alignment of the bracing arm with that portion of the main arm which is pivotally connected to its star-shaped member or part.

When one of the star-shaped members is thus moved along the support tube toward the other star-shaped member, the swing arm which has buckled inwardly automatically swings the main arm into a slightly open position before the knuckle joint is more fully bent to swing the main arm outwardly further into its fully open position.

The inward buckling of the chain of links and the initial outward swinging movement of each swing arm in the incipient opening movement of the frame facilitates the opening based upon a slight initial opening angle assumed by the main arm. The magnitude of that angle depends upon the length, position and shape of the respective swing arm.

According to a further feature of the invention, the swing arm can form a cam surface which rides along the support tube or post when the chain of links buckles inwardly. The cam permits the opening angle to be increased easily where desired without necessary increasing the length of the swing arm between its pivotal connections to the bracing arm and the main arm.

It has been found to be advantageous, moreover, to provide means on the swing arm for limiting the pivotal displacement relative to the main arm, i.e. means forming an abutment between the swing arm and the main arm. This abutment can be reached in the desired inwardly buckled condition of the link chain and can serve to insure that all of the main arms will assume the same inwardly swung orientations with respect to the support tube when the frame is closed. The abutment can advantageously engage when the swing arm lies substantially perpendicular to the support tube or post for a maximum opening angle in the slightly open position of the frame with the link chain inwardly buckled. According to the invention, moreover, the abutment between the swing arm and the main arm can be provided when the link chain is fully extended. In this case, when the main and bracing arms are pressed tightly against the support post and the inward buckling is eliminated, the intermediate link can rest against the main arm.

BRIEF DESCRIPTION OF THE DRAWINGS

The above and other objects, features, and advantages will become more readily apparent from the following description, reference being made to the accompanying drawing in which.

SPECIFIC DESCRIPTION

Figure 1:
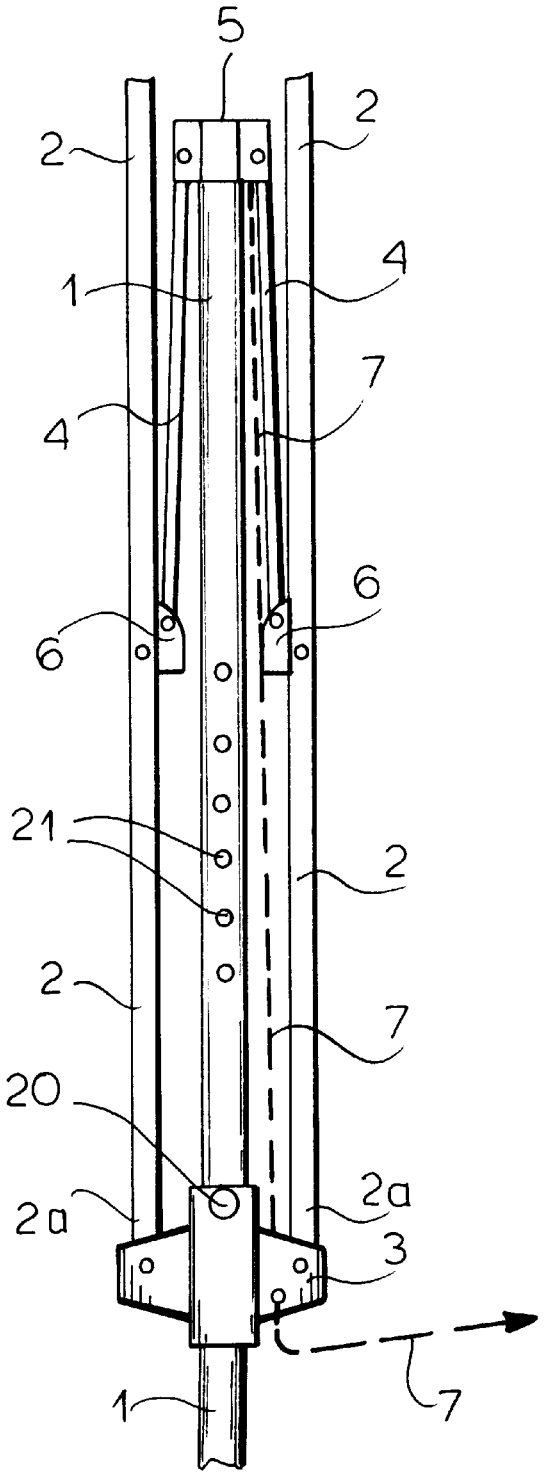
FIG. 1 is an elevational view diagrammatically illustrating a frame according to the invention with the main and bracing arms fully folded inwardly for a laundry drying frame, the principle of which can also be used for an umbrella canopy.
Figure 2:
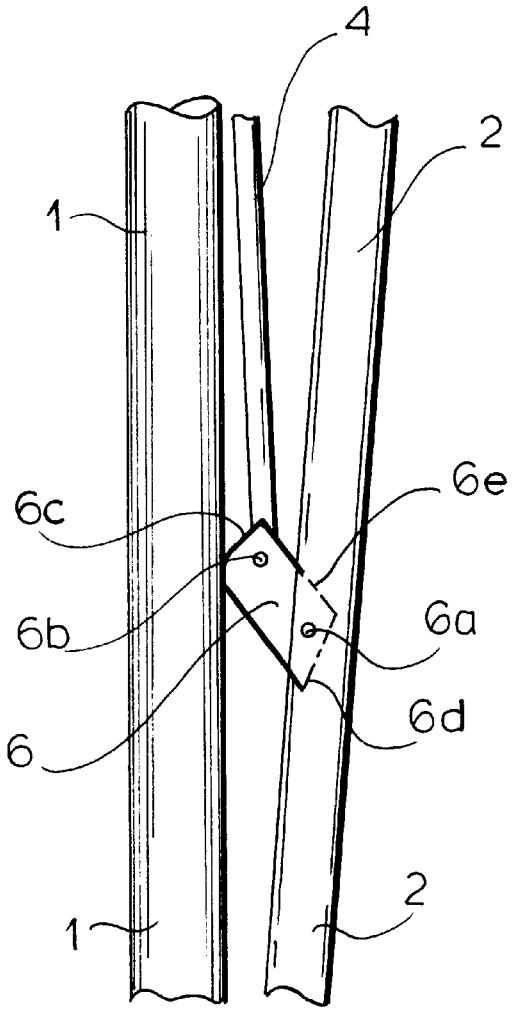
FIG. 2 is a detail view of the region of the intermediate link or swing arm in the slightly open position of the frame.
Figure 4:
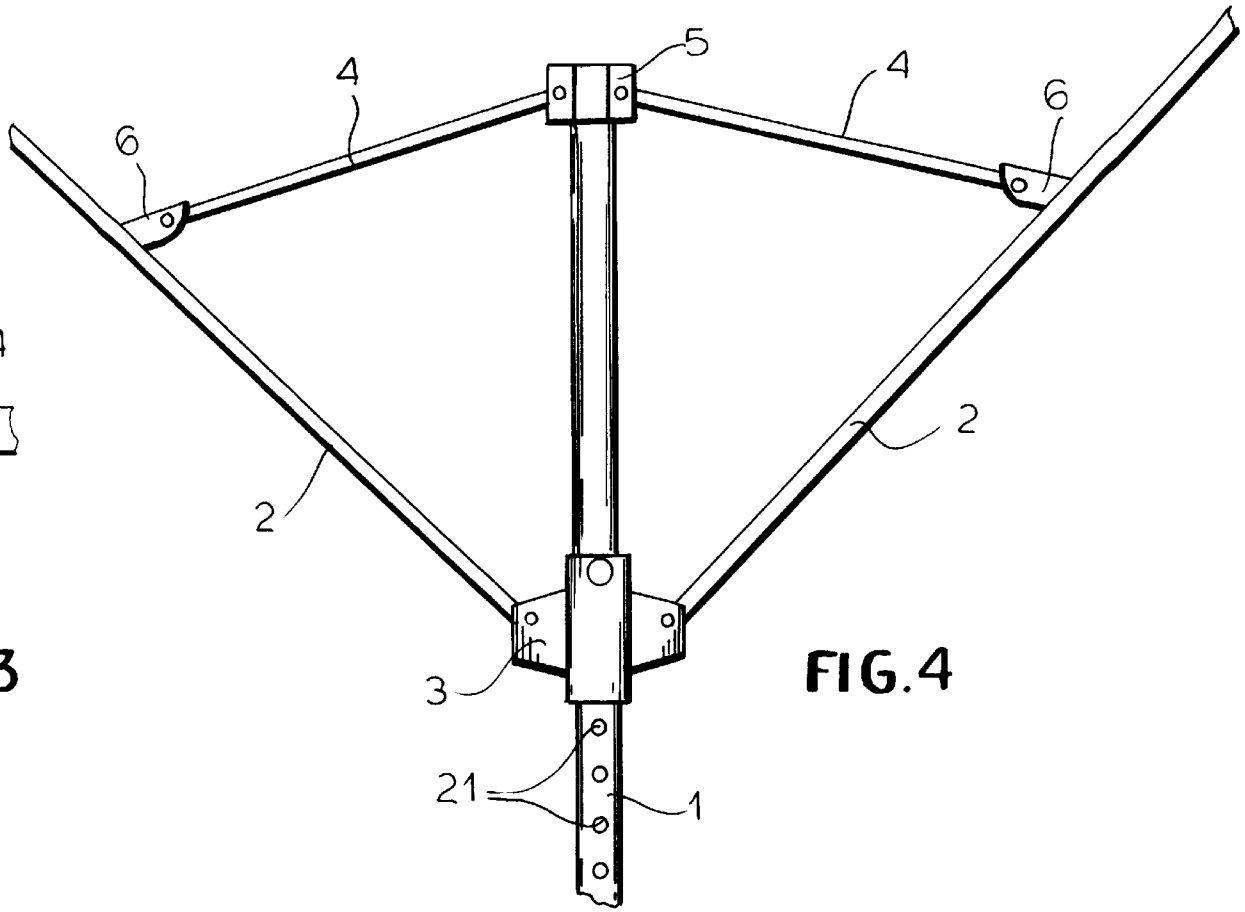
Figure 3:
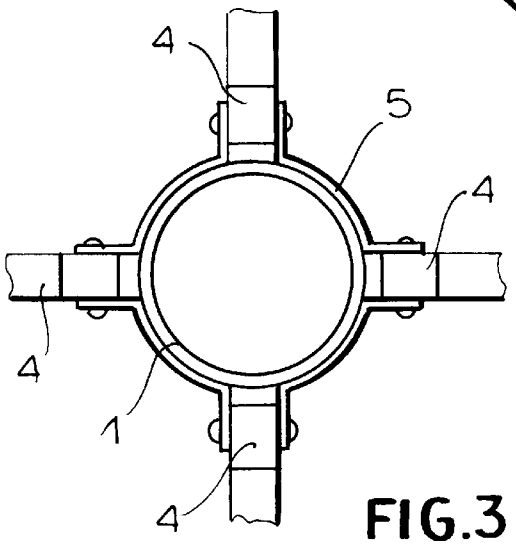

The laundry dryer shown in FIGS. 1 and 2 comprises a tube or post 1 which can be anchored in a base or stand or in the ground and can have four main arms 2 in a star-shaped array which can be spanned by cords (not shown) allowing laundry to be hung on the frame for drying. The arms 2 form a star-shaped array when they are swung outwardly and are pivotally connected at their lower ends 2*a* on a first star-shaped part 3 which is axially shiftable along the lower half of the support tube 1 and can be axially fixed therealong by an indexing arrangement which has diagrammatically been illustrated as a pin 20 which can be selectively fitted into one of a series of holes 21 along the support tube. The indexing arrangement allows the height of the lower star shaped part 3 to be selected.

The frame also comprises a star shaped array of bracing arms 4, each of which is associated with one of the main arms 2 and which is pivotally connected at its upper end to a second star-shaped part 5 which is axially fixed at the upper end of the support tube 1 or can be provided with an indexing arrangement as has been described for the lower star-shaped part 3, enabling it to be axially fixed at different levels along the upper half of the support tube 1.

The bracing arms 4 are connected at their lower ends by short pivot arms, swing arms or links 6 with the central regions of the respective main arms 2 so that there is a pivot 6*b* between each bracing arm 4 and each swing arm 6 and a pivot 6*a* between each swing arm 6 and the respective main arm 2. As a result, each bracing arm 4, swing arm 6 and main arm 2 forms a three link chain connecting the star-shaped parts 3 and 5, the swing arm 6 being the intermediate member of the chain.

The arms 2, 4 and 6, therefore, form four such link chains which are provided in diametrically opposite pairs and can be swung outwardly when, for example, the star-shaped member 3 is moved upwardly toward the star-shaped member 5 or the star-shaped member 5 is moved downwardly toward the star-shaped member 3 and which can be locked in their outwardly swung positions by axial fixing of the star-shaped members 3 and 5 relative to one another. The raising of the star-shaped member 3 from its lower position can be effected by hand or a cable 7 can be provided to allow the star-shaped members 3 and 5 to be moved relative to one another when the cable is pulled.

In the closed condition of the frame, with the star-shaped member 3 in its lower position, each of the arms 2 and 4 are swung inwardly and the 4 link chains can be fully extended (FIG. 1) so that the side 6*e* of each link 6 comes to rest along the respective main arm 2 as has been shown in FIG. 1.

With upward movement of the star-shaped member 3, in an initial phase, the swing arm 6 of each link chain is buckled inwardly, thereby swinging the respective main arm 2 to the slightly open position illustrated in FIG. 2 which facilitates further upward movement of the member 3 and spreading of the arms into their open positions. The size of the opening angle between the support arm 2 and the tube 1 with the buckling of the link chain depends upon the swing of the arm 6 and hence the distance between the pivot 6*a* and 6*b*.

To increase the opening angled with upward movement of the member 3, the swing arm 6 can be provided with a curved cam surface 6*c* which rides on the support tube 2. When, of course, the swing arms 2 are pressed inwardly, the link chain can be straightened and the position shown in FIG. 1 restored. The engagement of the abutment 6*d* against the main arm 2 for each link chain will limit the inward movement of the respective bracing arm. The abutment fixes the positions of the arms 4, 2 and 6 as a starting point for the buckling which creates the slight opening described previously. The opening angle which is selected can depend upon the weight and dimensions of the arms, the force which one wishes to exert by cable or hand for opening or the like.

At 6*d*, I have shown an abutment at the end of the swing arm 6 for limiting the pivotal movement of the swing arm 6 relative to the arm 2 and hence the opening angle of the arm 2 before the arm 4 can be swung outwardly.

It will be understood that the invention is also applicable to umbrellas, for example, garden umbrellas, sun umbrellas, the main arms by pivotally mounted on the upper star-shaped member and the bracing arms on the lower star-shaped member, the main arms being provided with a canopy. The pivot arm or swing arm is provided here as well as the intermediate link in a three link chain.

I claim:

1. A support frame comprising:

a vertical support tube;

an upper star-shaped member mounted on said support tube and a lower star-shaped member mounted on said support tube, at least one of said star-shaped members being axially shiftable along said support tube toward the other of said star-shaped member whereby said star-shaped members can be relatively displaced toward one another and apart;

a plurality of angularly equispaced main arms pivotally connected to a first of said star-shaped members;

a respective bracing arm assigned to each main arm and pivotally connected to a second of said star-shaped member whereby, upon relative movement of said star-shaped members toward one another, said arms are swung outwardly into an open position of the frame and when said star-shaped members are moved apart, said arms are swung inwardly into a closed position of said frame; and a respective swing arm pivotally connected between each bracing arm and the respective main arm whereby said swing arm form intermediate links in three link chains formed by each main arm, swing arm and bracing arm, said swing arm being so connected between the respective bracing arm and main arm in the respective three link chain that upon buckling of the respective three link chain, the main arm thereof is swung into a slightly opened position relative to said support tube.

2. The frame defined in claim 1 wherein each of said swing arms is formed with a curved cam surface along a portion thereof adjacent its connection to the respective bracing arm as riding along said support tube.

3. The frame defined in claim 1 wherein each of said swing arms has an abutment engageable with the respective main arm in a fully inwardly swung position of the respective main arm.

4. The frame defined in claim 1 wherein each of said swing arms has an abutment engageable with said main arm and limiting pivotal displacement of said swung arm relative to said main arm.

5. The frame defined in claim 1 wherein said frame is a frame for a laundry dryer.

6. The frame defined in claim 1 wherein a frame is a frame for an umbrella.

* * * * *